United States Patent [19]

McMichael

[11] Patent Number: 4,592,490

[45] Date of Patent: Jun. 3, 1986

[54] BEVERAGE DISPENSER SYSTEM CONVERTABLE BETWEEN GRAVITY AND PRESSURE

[75] Inventor: Dannie L. McMichael, Unionville, Conn.

[73] Assignee: The Coca-Cola Company, Atlanta, Ga.

[21] Appl. No.: 583,480

[22] Filed: Feb. 24, 1984

[51] Int. Cl.[4] ..... B67D 5/56

[52] U.S. Cl. ..... 222/129.1; 222/146.6; 137/271

[58] Field of Search ..... 222/129.1, 129, 130, 222/131, 146 C, 129.4, 145, 135; 141/285, 84; 137/269, 271; 285/131, 12

[56] References Cited

U.S. PATENT DOCUMENTS 3,902,636 9/1975 Zilk ..... 222/129.1

4,183,373 1/1980 Kay ..... 137/271

*Primary Examiner*—Joseph J. Rolla

*Assistant Examiner*—Kenneth Noland

*Attorney, Agent, or Firm*—Thomas R. Boston

[57] ABSTRACT

A counter electric beverage dispenser, that can be converted from pressure to gravity operation, and vice versa. The dispenser includes a plurality of dispensing valves, a plurality of syrup tubes, a plurality of water tubes, a plurality of gravity syrup tanks for use during gravity operation, a plurality of syrup inlet pipes for use during pressure operation, and a manifold for each dispensing valve to which is connected a dispensing valve, a water tube and a syrup tube. The dispensing valve is preferably a gravity electric valve that is modified when converting from gravity to pressure operation. A syrup flow control is added to the manifold when converting from gravity to pressure operation. The dispenser also provides an easy method for cleaning out the syrup tubes.

22 Claims, 11 Drawing Figures

BEVERAGE DISPENSER SYSTEM CONVERTABLE BETWEEN GRAVITY AND PRESSURE

BACKGROUND OF THE INVENTION

1. Field of the Invention

This invention relates generally to beverage dispensers, and in a preferred embodiment thereof to a counter electric beverage dispenser that is easily convertable from gravity to pressure and vice versa.

2. Description of the Prior Art

Present commercially available beverage dispensers are either gravity dispensers or pressure dispensers. The gravity dispensers employ one or more syrup tanks which are easily filled with syrup as they become empty. Pressure dispensers are fed syrup from pressure systems such as figals pressurized by $CO_2$ and such as bag-in-box systems in which syrup is pumped from a non-pressurized bag to a dispensing valve. These two types of dispensers (i.e. gravity and pressure) employ different dispensing valves.

It is an object of the present invention to provide a beverage dispenser which can be used as either a gravity dispenser or a pressure dispenser, which can be easily converted from one to the other, and in which each valve can be independently set up for either gravity or pressure operation.

It is another object of the invention to provide a system for cleaning out the gravity syrup lines without requiring the usual fitting attached to the low point of the gravity syrup lines.

It is another object of the invention to provide a mechanical syrup flow control in a syrup manifold rather than in a dispensing valve.

SUMMARY OF THE INVENTION

A counter electric beverage dispenser and method in which the dispenser includes a syrup compartment liner for holding a plurality of gravity syrup tanks, a plurality of dispensing valves, a plurality of manifolds connected one each to a respective dispensing valve, a plurality of syrup tubes each having an inlet opening and an outlet opening both of which openings are connected to a respective one of the manifolds, a plurality of water tubes each of which has an outlet opening connected to a respective one of the manifolds, a plurality of syrup inlet pipes having an inlet opening with a removable cap and having an outlet opening connected to a respective one of the syrup tubes, means for cooling the syrup and water tubes, means for individually converting each valve from gravity to pressure operation and vice versa, and means for cleaning out the syrup tubes. Each manifold includes a water passageway therethrough having an inlet port and an outlet port, a first syrup passageway therethrough having an inlet port and an outlet port, a second syrup passageway therethrough having an inlet port and an outlet port, and a flow control passageway therein which extends from an access port into fluid communication with the second syrup passageway. Syrup can be fed into a syrup tube either by gravity from a gravity syrup tank removably connected to the syrup inlet port of the first syrup passageway of a respective manifold, or from a pressure source removably connected to the inlet opening of a respective inlet pipe.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
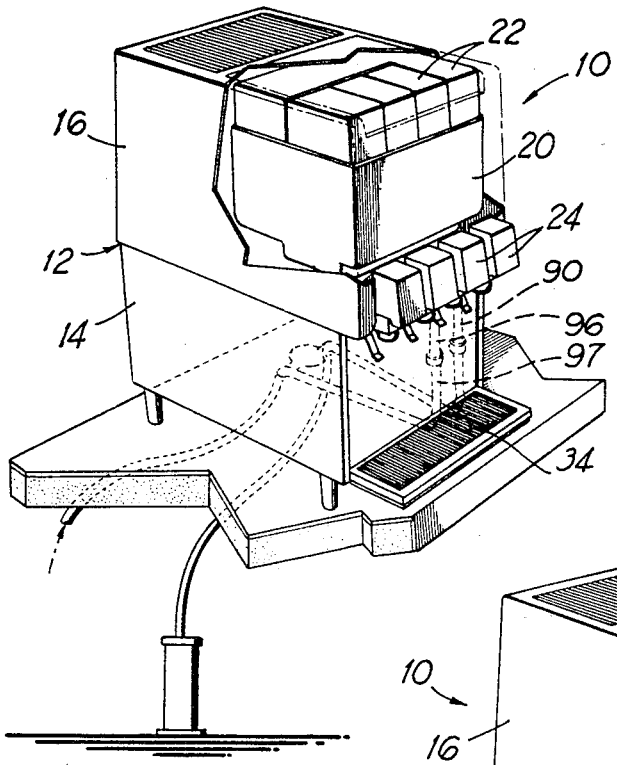
FIG. 1 is a partly broken away, front perspective view of the dispenser of the present invention set up for use as a gravity dispenser.

With reference now to the drawings, FIGS. 1–10 show a counter electric dispenser 10 according to the present invention. The dispenser 10 includes a housing 12 including a tank 14 and a shroud 16, a mechanical refrigeration system 18 (see FIG. 3), a syrup compartment liner 20 for holding four syrup tanks 22, four dispensing valves 24, each one connected to a respective one of four manifolds 26, four syrup cooling tubes 28, a carbonated water cooling tube 30, and a plain water cooling tube 32.

Figure 2:
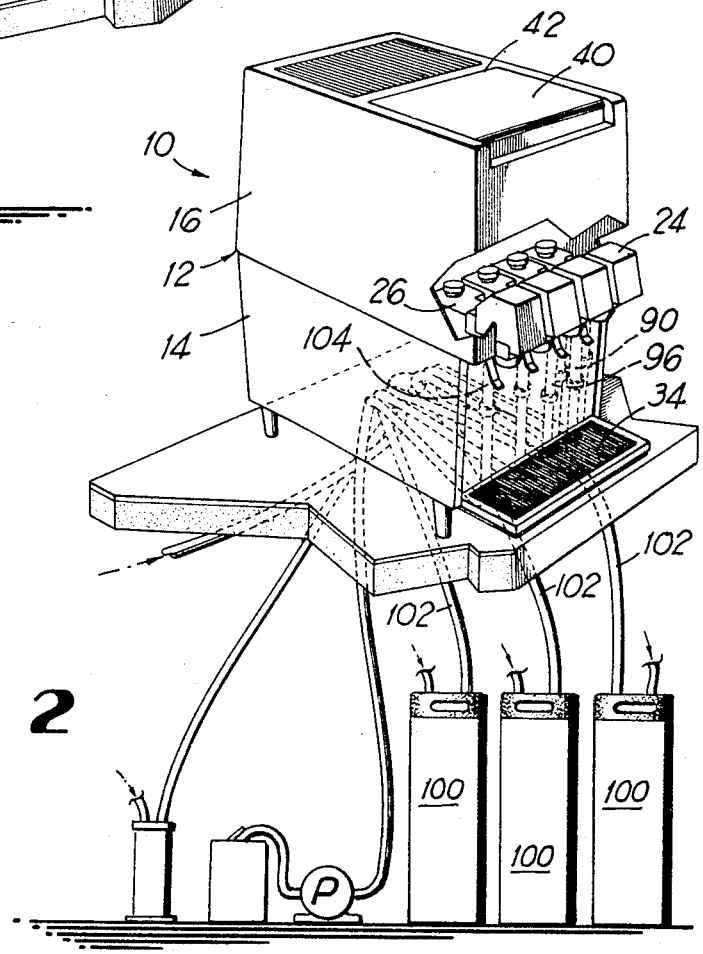
FIG. 2 is a similar perspective view of the dispenser of FIG. 1 but shown converted for use as a pressure dispenser.
Figure 3:
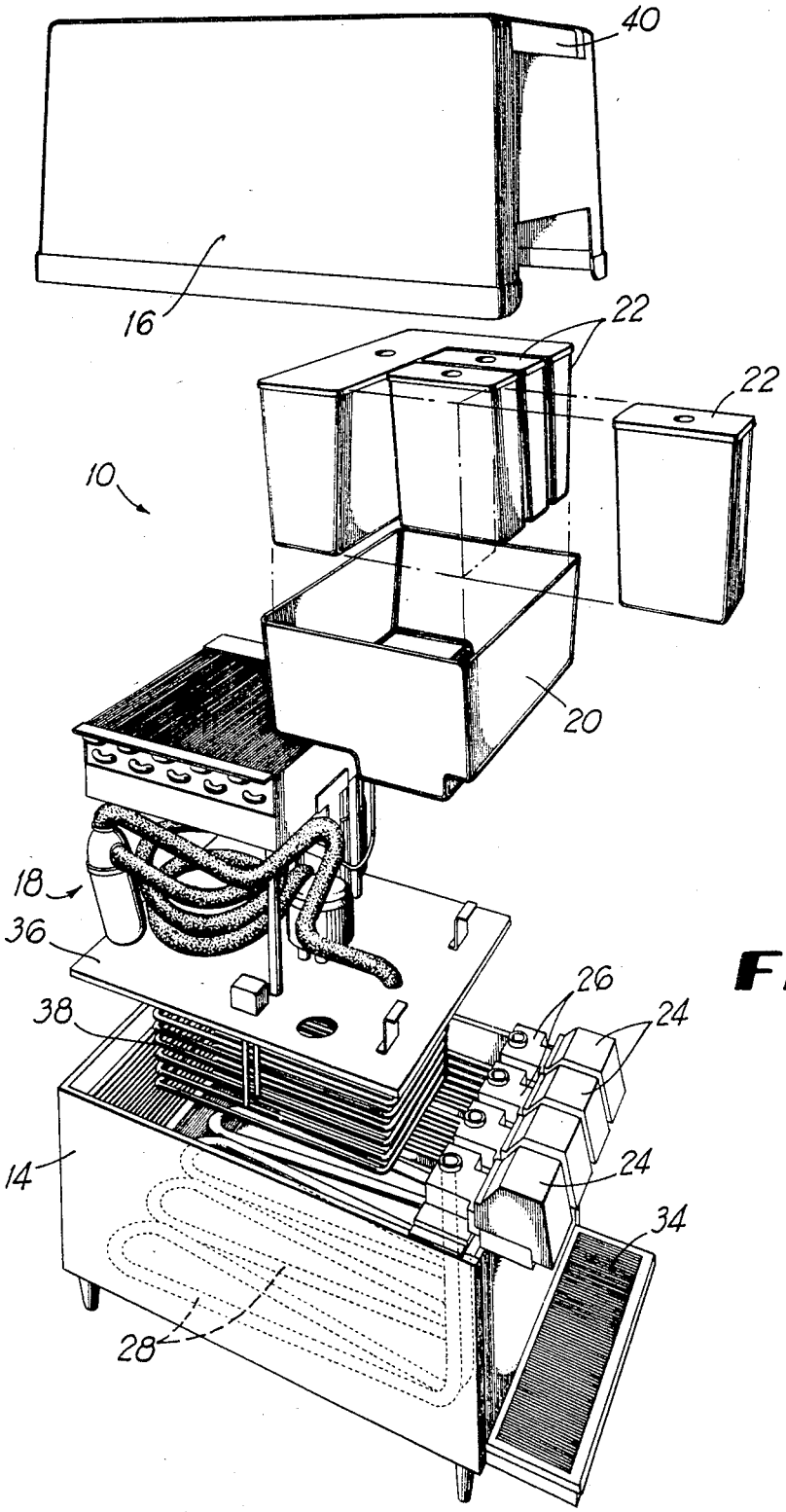
FIG. 3 is an exploded perspective view of the dispenser of FIG. 1.
Figure 4:
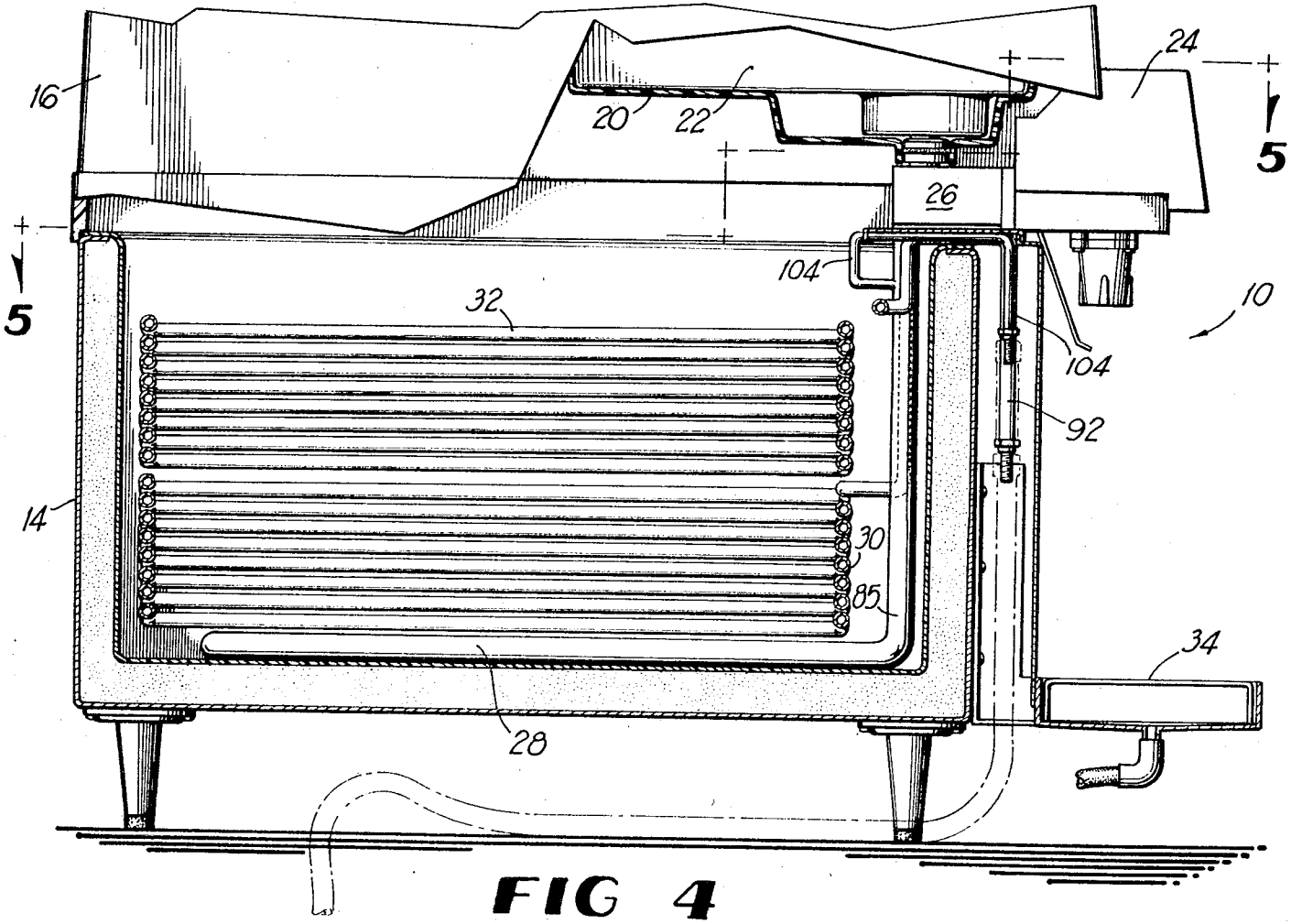
FIG. 4 is a partial side view, partly broken away and partly in cross section of the dispenser of FIG. 1.
Figure 5:
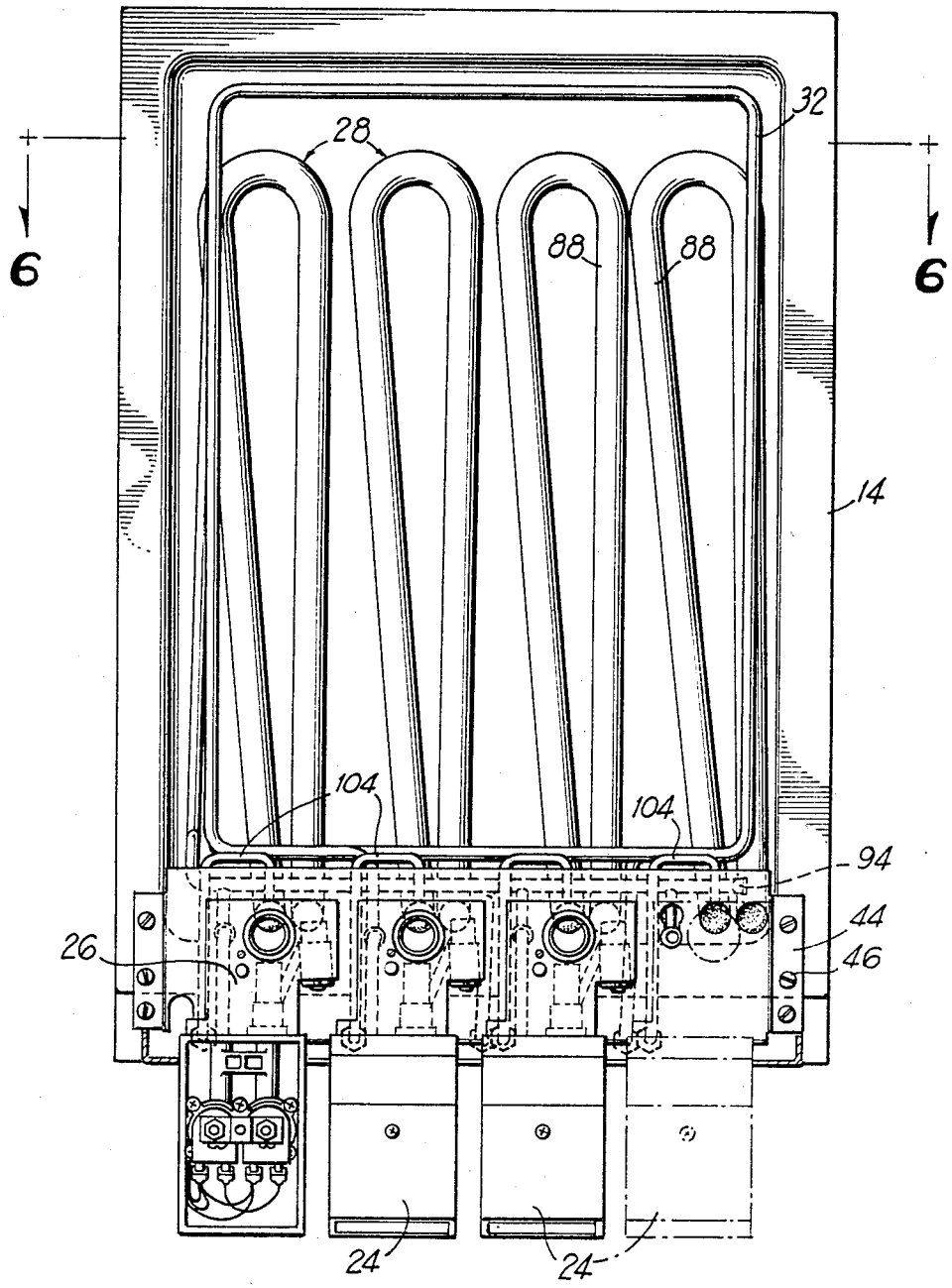
FIG. 5 is a top plan view of the lower portion of the dispenser of FIG. 1 with the shroud 16 removed.
Figure 6:
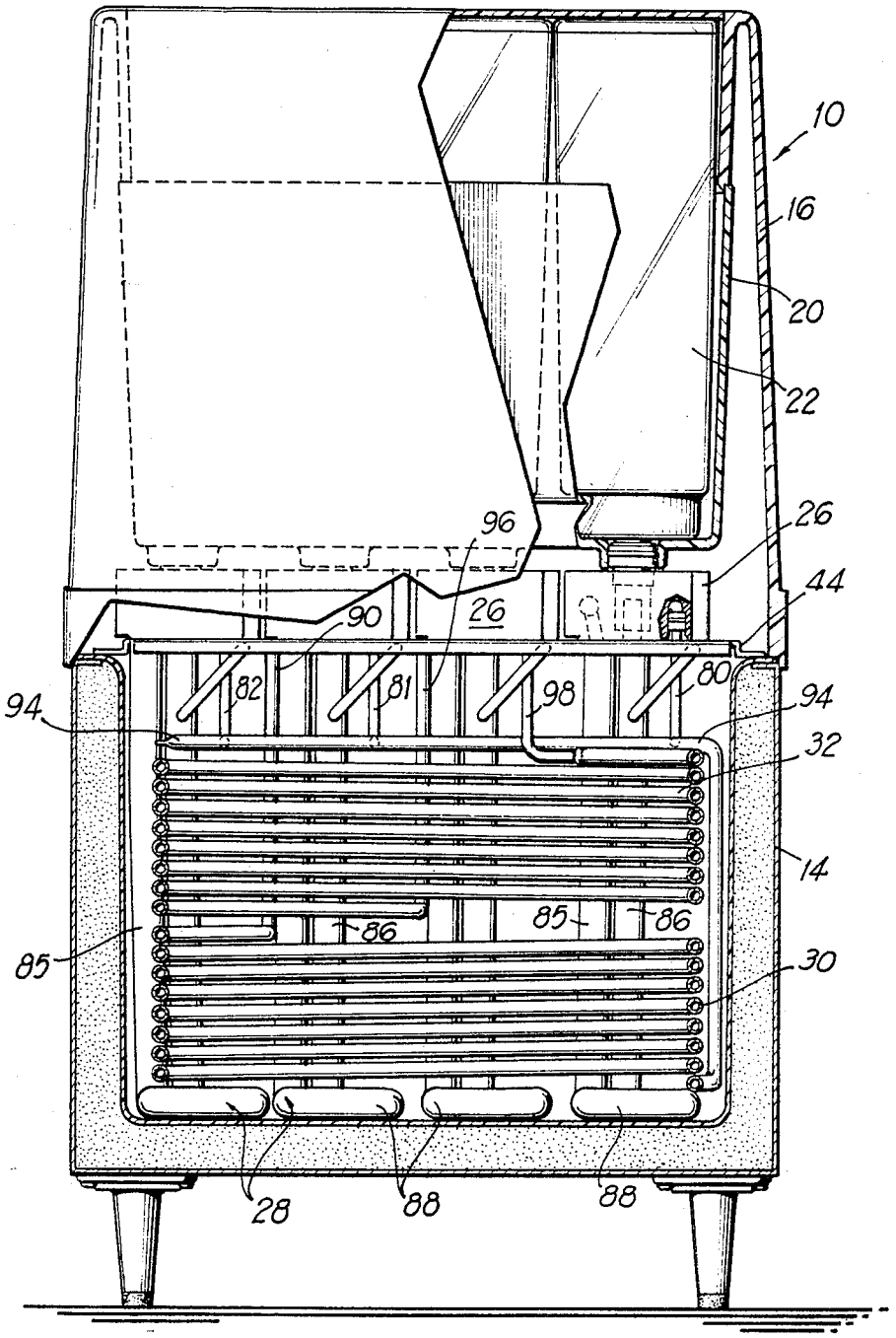
FIG. 6 is a partly broken away, partly cross-sectional view from the rear of the dispenser of FIG. 1 taken along line 6—6 of FIG. 5.

With reference primarily to FIGS. 1–3, the dispenser 10 preferably has four legs for supporting the dispenser up off of a counter (see FIGS. 1 and 2). The tank 14 includes a conventional vertical splash plate, a drip pan, and a cup rest 34 located beneath the valves 24. The refrigeration system 18 is conventional and includes a support plate 36 that rests on top of the tank 14. Cooling coils 38 extend below the plate 36 and produce an ice bank in an ice water bath in the tank 14 to cool the water and syrup in the tubes 28, 30 and 32. The shroud 16 also rests on top of the tank 14, and includes a top cover 40 that is hingedly connected to the remainder of the shroud at 42 to provide access to the syrup tanks 22 when the dispenser is being used as a gravity dispenser.

Figure 7A:
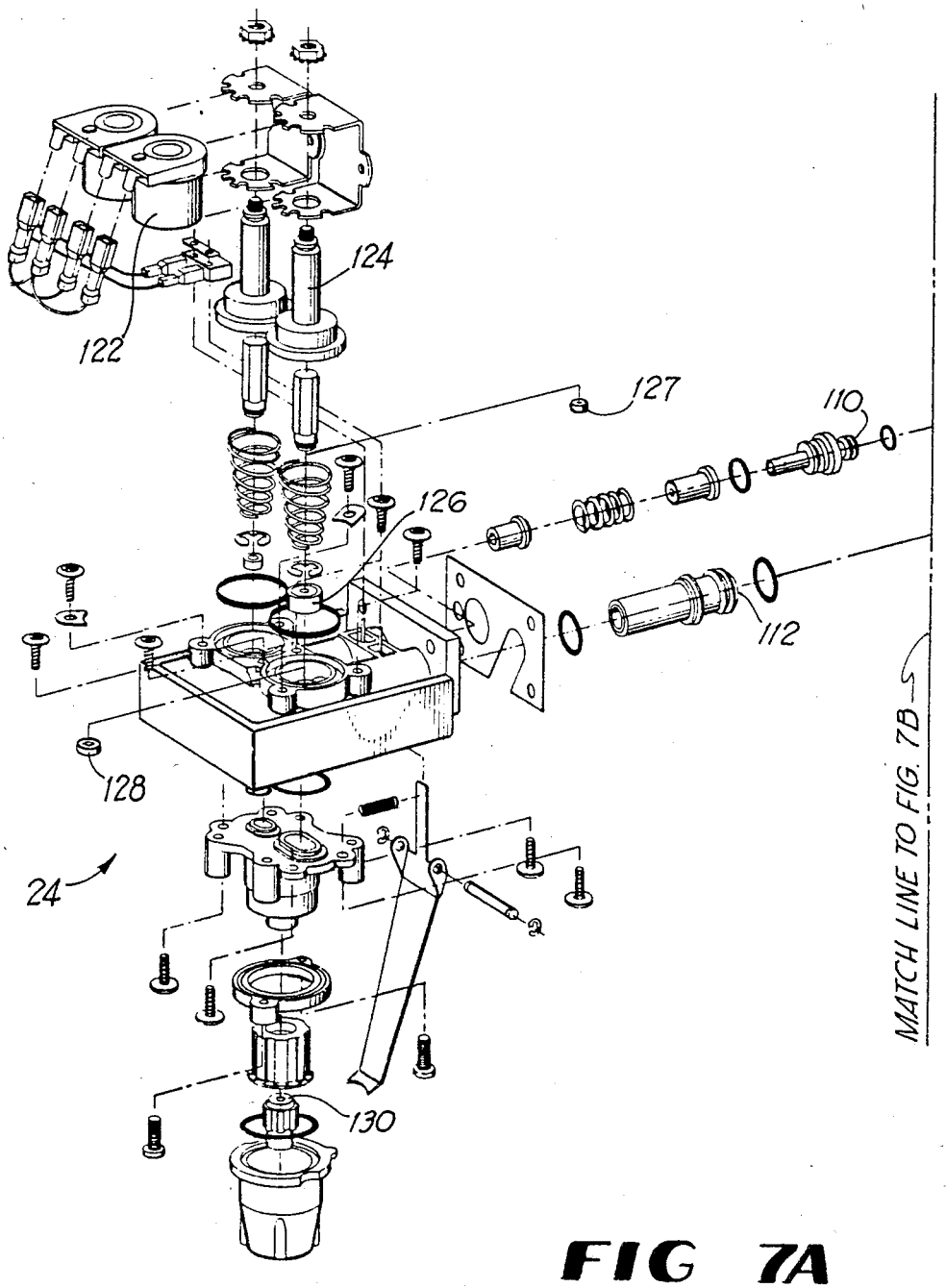
FIG. 7A is an exploded view of a valve used on the dispenser of FIG. 1.

When the dispenser 10 is being used as a gravity dispenser, the valves 24 can be a conventional gravity electric valve, such as that sold under the trademark DOLE·SELMIX GEV. This standard valve is shown in FIG. 7A and when it is desired to convert this valve from gravity to pressure operation, the valve is modified as will be described in detail below.

The manifolds 26 will now be described primarily with reference to FIGS. 4, 5, 6, 7B and 8–10. The manifolds 26 are connected by a single screw (see FIG. 5) to a manifold plate 44 which is, in turn, mounted on the top of the tank 14 by screws 46. The four manifolds 26 are identical to each other, with one manifold being provided for each valve 24. Each manifold 26 is preferably injection molded from a suitable plastic such as ZYTEL to provide a one-piece, molded manifold body having molded therein the passageways and ports described below. Alternatively it can be made of a block of material, such as DELRIN with the passageways machined therein. With reference to FIGS. 7B, 8, 9 and 10, each manifold 26 includes: (1) a water passageway 50 having an inlet port 52 and an outlet port 54 for connection to a water inlet fitting 110 of the valve 24; (2) a first syrup passageway 56 having an inlet port 58 in an extension 59 and an outlet port 60 in an extension 61 provided with an o-ring; (3) a second syrup passageway 62 having an inlet port 64 in an extension 65 provided with an o-ring and an outlet port 66 for connection to a syrup inlet fitting 112 of the valve 24, and (4) a flow control passageway 68 in fluid communication with the second syrup passageway 62 and having an access port 70.

Figure 7B:
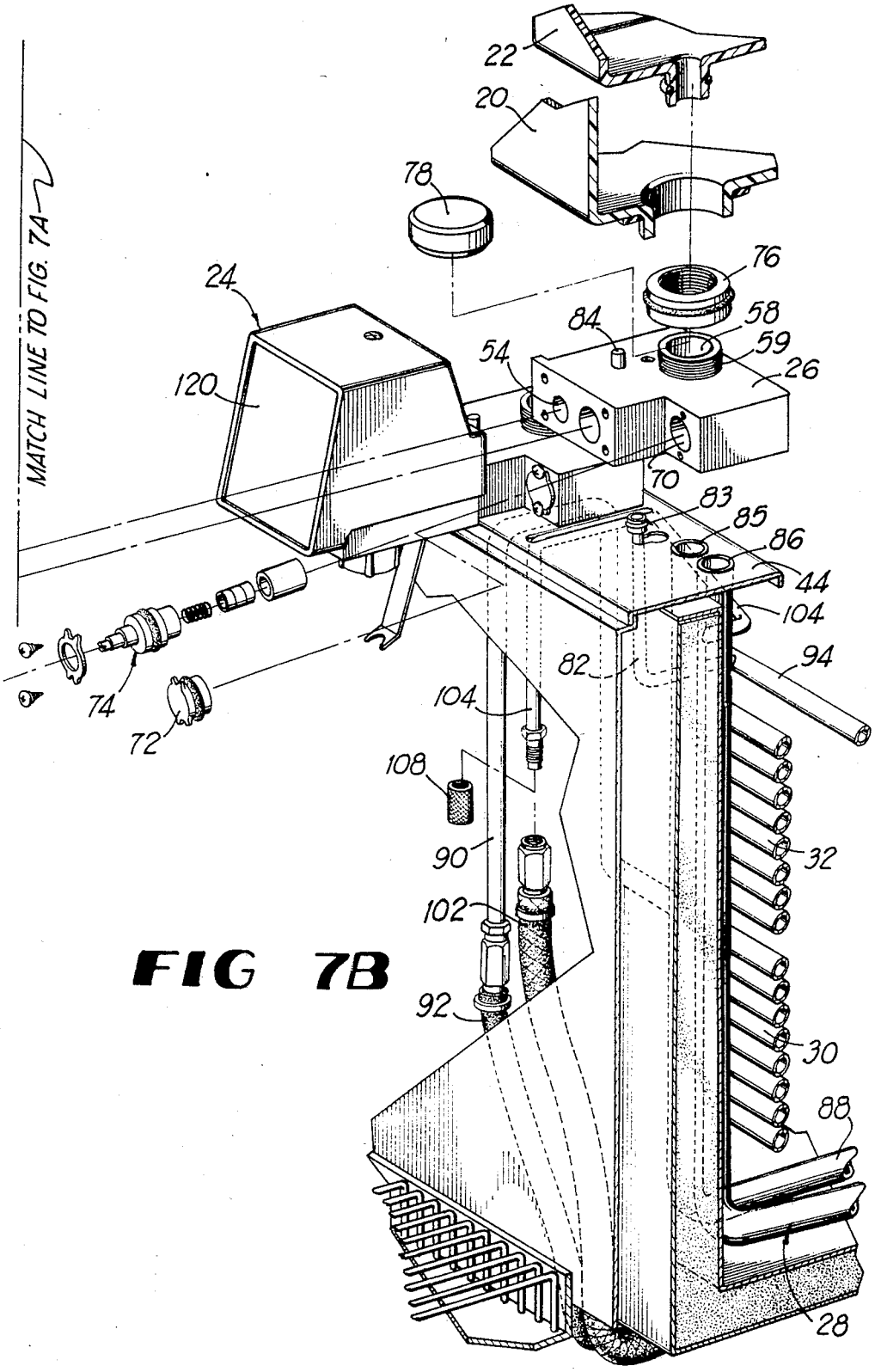
FIG. 7B is a partial, perspective, partly cross-sectional, partly exploded view of the valve and manifold portion of the dispenser of FIG. 1.
Figure 8:
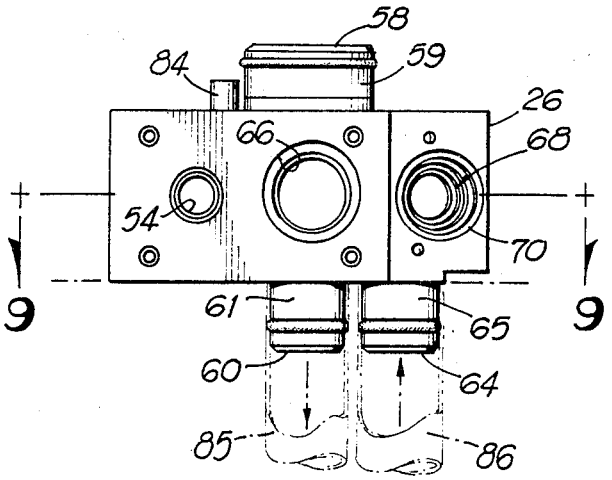
FIG. 8 is a front view of the manifold of the present invention.
Figure 9:
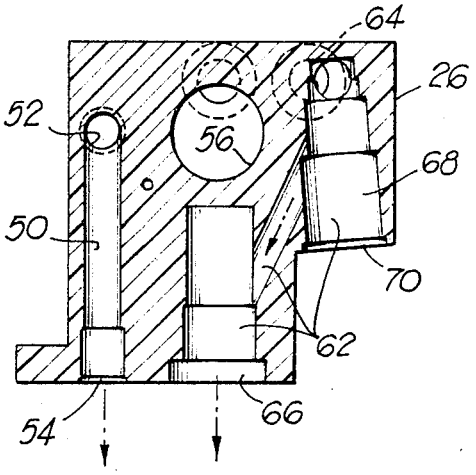
FIG. 9 is a cross-sectional top view of the manifold of FIG. 8.
Figure 10:
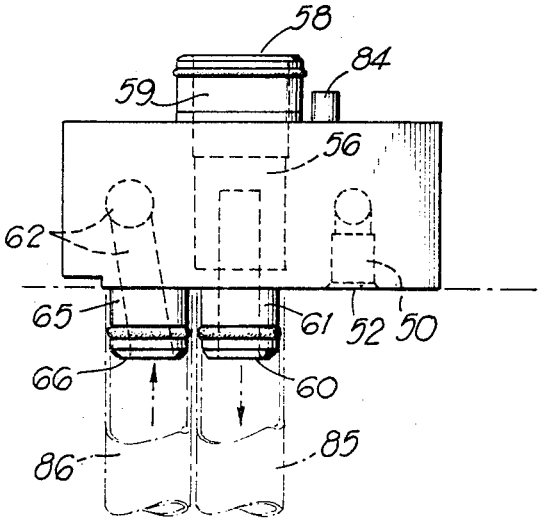
FIG. 10 is a rear view of the manifold of FIGS. 8 and 9.

When the dispenser 10 is operated in its gravity mode, the access port 70 of the manifold 26 is closed by a cover 72 and a syrup tank 22 is in fluid communication with the inlet port 58 (FIG. 7B). To convert the dispenser 10 to pressure operation, the ring 76 is removed and replaced with a plastic screw cap 78 closing the inlet port 58, and the cover 72 is removed and replaced with a mechanical flow control 74. The flow control 74 can be a conventional flow control such as that used in the valve shown in U.S. Pat. No. 4,266,726.

The manifold 26 is installed, prior to inserting the screw therethrough and into the plate 44, by pressing it down such that the extensions 61 and 65 sealingly engage inside of the inlet opening and the outlet opening of the vertical legs 85 and 86, respectively, of the syrup tube 28, and such that the end of a water tube 82, having an o-ring 83, sealingly engages inside of the water inlet port 52 on the manifold 26. The ring 76 or the cap 78 is screwed onto the extension 59 depending upon whether the manifold 26 is to be used for gravity or pressure operation, respectively. The ring 76 is provided with an o-ring to seal against the tubular opening in the bottom of the syrup compartment liner 20. The bottom wall of the syrup compartment liner preferably has a drain port which can be connected by a tube to the drip pan. The syrup tanks 22 each have an extension 87 with an o-ring, which extension 87 sealingly extends into the inlet port 58. The manifold 26 also has an upstanding registration pin 84 to be received in a corresponding opening (not shown) in the bottom of the syrup compartment liner 20.

The syrup tubes 28 each include two upstanding leg portions 85 and 86 connected at the bottom by a loop portion 88 that is horizontal and adjacent to the bottom of the tank 14. The tubes 28 are each connected to the plate 44, preferably by welding, and are supported thereby.

A plurality of pressure syrup inlet pipes 104 are connected one each to a respective one of the inlet legs 85 of the syrup tubes 28 as shown in FIGS. 4, 5, 6 and 7B. The other end of each of the syrup inlet pipes 104 is provided with a removable cap 108. When converting from gravity to pressure operation, the ring 76 is removed from the extension 59 of the manifold 26 and replaced by the cap 78, and the cap 108 on the syrup inlet pipe 104 is removed and a syrup line 102 is connected to the pipe 104. Syrup is then supplied to the inlet leg 85 of the syrup tube 28 from a pressure source, such as from a figal 100 (see FIG. 2) or from a pump 106 of a bag-in-box system (see FIG. 2). Each inlet pipe 104 preferably includes a vertical portion located adjacent to the front of the dispenser 10 and having the removable cap 108.

The syrup tubes 28 have an inside diameter (I.D.) of from about $\frac{5}{8}$ inch to about one and one-fourth inch and preferably have a $\frac{3}{4}$ inch I.D. This large inside diameter allows the syrup, in the gravity mode, to be able to flow from a tank 14 to a respective valve 24.

Two water cooling tubes 30 and 32 are preferably provided in the dispenser 10. The tube 30 includes a series of coils and is located toward the bottom of the tank 14. The tube 30 includes an inlet tube 90 (see FIG. 7B) located at the front of the dispenser 10 behind the splash plate; the inlet tube 90 has a fitting at the end thereof such that it can be connected to a source of carbonated water by a flexible hose 92 (see FIG. 7B). The tube 30 also includes a closed end outlet tube 94 (see FIGS. 6 and 7B) to which three water tubes 80, 81 and 82 are connected, each having a distal end with an o-ring (such as o-ring 83 in FIG. 7B) for sealingly connecting to an inlet port 52 of the manifold 26. The distal end of each of the water tubes 80, 81 and 82 extends loosely through a larger opening in the manifold plate 44.

The water tube 32 includes a series of coils located above those of the tube 30. The tube 32 has an inlet tube 96 located at the front of the dispenser 10 (see FIG. 1) and has a fitting at the end thereof such that the inlet tube 96 can be connected to a source of water by a flexible hose 97. The tube 30 also includes a water tube 98 (FIG. 6) provided with an o-ring and extending through an opening in the manifold plate 44 for sealing connection to an inlet port 52 of a manifold 26, in an identical manner to that of water tube 82. It is noted that the water tube 30 will usually be connected to a carbonated water source and that the water tube 32 will be connected to either plain water or carbonated water depending on what beverage is to be dispensed through the single valve connected to the water tube 32.

It is noted that the dispenser 10 preferably does not include a built-in carbonator. A separate carbonator can be used with a flexible hose 92 connected to the fitting on the end of the inlet tube 90 (see FIG. 7B). A hose 97 is connected to the inlet tube 96 for feeding plain water to the water tube 32.

FIG. 1 shows the dispenser 10 arranged for use as a gravity dispenser with a carbonated water hose 92 connected from a carbonator to the inlet tube 90 and a plain water hose 97 connected to the inlet tube 96. A syrup compartment liner 20 is located on the four manifolds 26 and four syrup tanks 22 are positioned in the syrup compartment liner. Each of the syrup tanks 22 have a conventional float system as used in gravity beverage dispensers. The access port 70 (see FIG. 7B) in each manifold is closed by a cover 72, and a ring 76 is connected to the extension 59 of each manifold 26, the syrup compartment liner 20 is fitted onto the rings 76, and four syrup tanks 22 are installed with their extensions 87 in sealed communication with the respective inlet ports 58.

FIG. 2 shows the dispenser 10 arranged for use solely as a pressure dispenser. It is noted that the syrup compartment liner 20 and the syrup tanks 22 are omitted, and that caps 78 are connected to each of the extensions 59 of each of the manifolds 26. In addition, three figals 100 are connected with their syrup lines 102 connected one each to a respective one of the inlet pipes 104, which are in turn connected one each to one of the syrup cooling tubes 28. A pump 106 of a bag-in-box system is connected by a flexible hose to the other one of the four inlet pipes 104 (in FIG. 2 it is connected to the left most pipe 104).

The manner of converting from gravity to pressure, and vice versa, has already been described above except with respect to the valve 24. While a gravity valve can simply be replaced with a pressure valve and vice versa, it is preferred to make certain modifications to the valve 24 as set forth below. The following steps are taken to convert from gravity to pressure operation, and include the modification to the valve as well as all other steps: (1) remove the valve cover 120; (2) remove the syrup solenoid coil 122; (3) remove the armature guide assembly 124 (the metal post and hat); (4) remove the larger rubber armature tip 126 used in gravity operations and replace it with the smaller armature tip 127 used in pressure valves; (5) press a syrup seat 128 having an orifice smaller than that in the gravity valve and the same as that in a pressure valve, into the syrup port (not visible in FIG. 7A) of the valve; (6) replace the armature guide assembly and syrup solenoid coil; (7) remove the cover 72 from the manifold 26; (8) insert the mechanical flow control 74 into the flow control passageway 68 with the control fully seated and secure it in place with the two screws shown in FIG. 7B; (9) remove the syrup compartment liner 20 with the tanks 22 therein; (10) remove the ring 76 from the manifold 26; (11) replace the ring 76 with the plastic screw cap 78; (12) replace the syrup compartment liner 20 with the syrup tanks 22 therein (the tanks 22 will no longer be in fluid communication with the inlet port 58); (13) remove the cap 108 from the syrup pipe 104 and plumb in the pressure syrup line 102; and (14) remove the dispenser nozzle and remove the syrup shim stock orifice 130 and replace the nozzle to provide a larger opening therethrough.

It will be seen that in order to convert from gravity to pressure, it is preferred to drain the syrup out of the tanks 22 to prevent spillage.

Another aspect of this invention is that of cleanout of each of the syrup tubes 28. This is accomplished by connecting a water line or an air line (or any other cleaning fluid) under pressure to each of the inlet pipes 104 of each tube 28 and blowing out the tubes 28 under pressure. The cover 78, of course, will be in position to close the inlet port 58. The valve 24 is held open to allow the cleaning fluid and syrup to escape from the tube 28. This procedure is continued until the syrup tube 28 is clean.

While the preferred embodiment of this invention has been described above, it is to be understood that variations and modifications can be made therein. For example, while the dispenser does not include a built-in carbonator, it can do so if desired. Further, while four valves are shown, more or fewer can be used. While two water coils are shown, any number can be used including, for example, a single water coil for the dispenser 10, or alternatively, a separate one for each valve. A particular valve has been shown, however, other valves can be used and rather than modify the valve to convert between gravity and pressure, the valve can simply be replaced with a different valve. The manifold can be made of other materials, in other ways, and can have other shapes. The flow control does not need to be in the manifold but can be in the valve if desired. The pressure syrup inlet pipes can be located other than in the front of the dispenser, if desired. Other means for cooling the water and syrup can be used in place of the mechanical refrigeration system 18. The dispenser 10 is not limited to use as a counter top dispenser.

It should thus be apparent that various alterations, modifications, and changes may be made in the preferred embodiment illustrated herein without departing from the spirit and scope of the present invention as defined in the appended claims.

What is claimed:

1. A beverage dispenser comprising:

(a) a syrup tube having an inlet opening and an outlet opening;

(b) a water tube having an inlet opening and an outlet opening;

(c) a manifold having a first syrup passageway therethrough having a syrup inlet port and a syrup outlet port, and having a second syrup passageway therethrough having a syrup inlet port and a syrup outlet port;

(d) said syrup tube being connected to said manifold with said syrup tube inlet opening being connected to said syrup outlet port of said first syrup passageway and with said syrup tube outlet opening being connected to said syrup inlet port of said second syrup passageway;

(e) a syrup inlet pipe connected at one end thereof to said syrup tube and having a removable cap at the other end thereof;

(f) said syrup inlet port of said first syrup passageway having means for connecting thereto one of a syrup gravity tank or a cover; and (g) said water tube outlet opening being located adjacent to said outlet port of said second syrup passageway, whereby a dispensing valve having a water inlet port and a syrup inlet port can be connected to said water outlet opening and to said outlet port of said second syrup passageway, respectively.

2. The beverage dispenser as recited in claim 1 wherein said manifold includes a flow control passageway therein extending from an access port into fluid communication with said second syrup passageway, and means for connecting one of a cover over, or a syrup flow control into, said flow control passageway.

3. The beverage dispenser as recited in claim 1 including a syrup gravity tank connected to said inlet port of said first syrup passageway and including a cap connected to the other end of said syrup inlet pipe.

4. The beverage dispenser as recited in claim 1 including a cover on said inlet port of said first syrup passageway, including a syrup line connected to the other end of said syrup inlet pipe, and a syrup flow control positioned in said flow control passageway.

5. The beverage dispenser as recited in claim 1 including a dispensing valve having a water inlet port and a syrup inlet port connected to said dispenser, with said valve water inlet port being connected to said outlet of said water pipe and with said valve syrup inlet port being connected to said outlet port of said second syrup passageway.

6. The beverage dispenser as recited in claim 1 wherein said manifold includes a water passageway therethrough having a water inlet port and a water outlet port and wherein said outlet opening of said water tube is connected to said manifold water inlet port.

7. The beverage dispenser as recited in claim 1 wherein said dispenser includes a plurality of said manifolds, a plurality of said syrup tubes, and a plurality of said water tubes.

8. The beverage dispenser as recited in claim 1 including means for cooling said syrup tube and said water tube.

9. The beverage dispenser as recited in claim 1 wherein said manifold includes a water passageway therethrough having a water inlet port and a water outlet port, wherein said outlet opening of said water tube is connected to said manifold water inlet port, wherein said manifold includes a flow control passageway therein extending from an access port into fluid communication with said second syrup passageway and means for connecting one of a cover over, or a syrup flow control into, said flow control passageway, and means for cooling said syrup tube and said water tube.

10. The beverage dispenser as recited in claim 9 including a dispensing valve having a water inlet port and a syrup inlet port connected to said dispenser, with said valve water inlet port being connected to said outlet port of said water passageway and with said valve syrup inlet port being connected to said outlet port of said second syrup passageway.

11. The beverage dispenser as recited in claim 10 including a syrup gravity tank connected to said inlet port of said first syrup passageway and including a cap connected to the other end of said syrup inlet pipe.

12. The beverage dispenser as recited in claim 10 including a cover on said inlet port of said first syrup passageway and including a syrup line connected to the other end of said syrup inlet pipe.

13. The beverage dispenser as recited in claim 10 including a plurality of said manifolds, a plurality of said syrup tubes, and a plurality of said water tubes.

14. A beverage dispenser comprising:

(a) a syrup tube having an inlet opening and an outlet opening;

(b) a water tube having an inlet opening and an outlet opening;

(c) a manifold having a first syrup passageway therethrough having a syrup inlet port and a syrup outlet port, a second syrup passageway therethrough having a syrup inlet port and a syrup outlet port, and a flow control passageway therein extending from an access port into fluid communication with said second syrup passageway and means for connecting one of a cover over, or a syrup flow control into, said flow control passageway;

(d) said syrup tube being connected to said manifold with said syrup tube inlet opening being connected to said syrup outlet port of said first syrup passageway and with said syrup tube outlet opening being connected to said syrup inlet port of said second syrup passageway;

(e) said syrup inlet port of said first syrup passageway having means for connecting thereto one of a syrup gravity tank or a cover; and (f) said water tube outlet opening being located adjacent to said outlet port of said second syrup passageway, whereby a dispensing valve having a water inlet port and a syrup inlet port can be connected to said water outlet opening and to said outlet port of said second syrup passageway, respectively.

15. The beverage dispenser as recited in claim 14 wherein said manifold includes a water passageway therethrough having a water inlet port and a water outlet port and wherein said outlet opening of said water tube is connected to said manifold water inlet port.

16. The beverage dispenser as recited in claim 14 including a dispensing valve having a water inlet port and a syrup inlet port connected to said dispenser with said valve water inlet port being connected to said outlet of said water pipe and with said valve syrup inlet port being connected to said outlet port of said second syrup passageway.

17. The beverage dispenser as recited in claim 14 wherein said dispenser includes a plurality of said manifolds, a plurality of said syrup tubes, and a plurality of said water tubes.

18. The beverage dispenser as recited in claim 14 including a syrup gravity tank connected to said inlet port of said first syrup passageway and including a cover connected over said access port of said flow control passageway.

19. The beverage dispenser as recited in claim 14 including means for cooling said syrup tube and said water tube.

20. A method for converting a beverage dispenser from gravity to pressure operation comprising:

(a) providing a beverage dispenser including a syrup tube having an inlet opening and an outlet opening; a water tube having an inlet opening and an outlet opening; a manifold having a water passageway therethrough having a water inlet port and a water outlet port, a first syrup passageway therethrough having a syrup inlet port and a syrup outlet port, a second syrup passageway therethrough having a syrup inlet port and a syrup outlet port and a flow control passageway therein extending from an access port into fluid communication with a second syrup passageway, said syrup tube being connected to said manifold with said syrup tube inlet opening being connected to said syrup outlet port of said first syrup passageway and with said syrup tube outlet opening being connected to said syrup inlet port of said second syrup passageway, a syrup inlet pipe connected at one end thereof to said syrup tube and having a removable cap at the other end thereof, said syrup inlet port of said first syrup passageway having means for connecting thereto one of a syrup gravity tank or a cover; and (b) connecting a gravity syrup tank to said syrup inlet port of said first syrup passageway, positioning said removable cap on the other end of said syrup inlet pipe, and positioning said removable cover on said access port, when it is desired to operate said beverage dispenser as a gravity dispenser; and (c) converting said beverage dispenser from gravity operation to pressure operation by removing said syrup gravity tank from said manifold and providing a cap on said inlet port of said first syrup passageway, removing said cover from said access port and installing a syrup flow control into said flow control passageway, removing said removable cap from said other end from said syrup inlet pipe and connecting a syrup line from a pressure source to said other end of said syrup inlet pipe.

21. The method as recited in claim 20 including connecting a dispensing valve to said dispenser, said dispensing valve having a water inlet port and a syrup inlet port, such that said valve water inlet port is connected to said outlet opening of said water pipe and such that said valve syrup inlet is connected to said outlet port of said second syrup passageway, and converting said valve from gravity operation to pressure operation by positioning, in the syrup port of said valve, a syrup seat having an orifice therethrough that is smaller than the orifice in said syrup port of the said valve, removing a larger armature tip used for gravity operation and replacing it with a smaller armature tip used for a pressure valve, and removing a syrup shim stock orifice from the nozzle of the gravity valve.

22. The method as recited in claim 20 wherein said dispenser includes a syrup inlet pipe connected at one end thereof to said syrup tube and having a removable cap at the other end thereof and cleaning said syrup tube by closing said inlet port of said first syrup passageway, connecting a hose from a cleaning fluid source under pressure to the other end of said syrup inlet pipe, maintaining said valve open, and feeding pressurized cleaning fluid into said syrup inlet pipe, through said syrup tube and out said valve.

* * * * *